US007002483B2

(12) United States Patent
Alrabady

(10) Patent No.: US 7,002,483 B2
(45) Date of Patent: Feb. 21, 2006

(54) CONFIGURABLE ARRANGEMENT OF MULTIPLE TRANSMITTERS AND MULTIPLE RECEIVERS FOR THE PERFORMANCE OF REMOTE CONVENIENCE FUNCTIONS

(75) Inventor: Ansaf Ibrahem Alrabady, Livonia, MI (US)

(73) Assignee: TRW Inc., Lyndhurst, OH (US)

( * ) Notice: Subject to any disclaimer, the term of this patent is extended or adjusted under 35 U.S.C. 154(b) by 628 days.

(21) Appl. No.: 09/904,111

(22) Filed: Jul. 11, 2001

(65) Prior Publication Data

US 2003/0011485 A1 Jan. 16, 2003

(51) Int. Cl.
*G08C 19/00* (2006.01)

(52) U.S. Cl. ..... 340/825.69; 340/457

(58) Field of Classification Search ..... 340/825.69, 340/825.72, 5.23, 457, 438, 825.24, 825.37, 340/5.22; 180/168, 169; 713/153, 162, 713/169, 170; 446/456; 463/39; 341/176, 341/173

See application file for complete search history.

(56) References Cited

U.S. PATENT DOCUMENTS 4,334,221 A 6/1982 Rosenhagen et al.
5,109,221 A * 4/1992 Lambropoulos et al. ... 340/5.22
5,680,134 A 10/1997 Tsui
5,712,638 A * 1/1998 Issa ..... 341/176
5,731,756 A 3/1998 Roddy
5,854,594 A 12/1998 Lin et al.
5,898,397 A * 4/1999 Murray ..... 341/176
5,937,065 A * 8/1999 Simon et al. ..... 380/262
6,005,508 A 12/1999 Tsui
6,259,362 B1 * 7/2001 Lin ..... 340/457
6,304,968 B1 * 10/2001 Hacker et al. ..... 713/153
6,538,558 B1 * 3/2003 Sakazume et al. ..... 340/5.23
6,661,351 B1 * 12/2003 Matsushiro ..... 340/825.69

* cited by examiner

*Primary Examiner*—Michael Horabik
*Assistant Examiner*—William Bangachon
(74) *Attorney, Agent, or Firm*—Tarolli, Sundheim, Covell & Tummino L.L.P.

(57) ABSTRACT

An arrangement (10) for remotely controlling convenience functions at a plurality of devices (35X–35Y) includes a plurality of device-based receivers (30X–30Y) and a plurality of portable transmitters (20A–20C). Each of the plurality of receivers (30X–30Y) include the capability of receiving a remote convenience function request signal and conveying a remote convenience function request message to a device operations system (38X or 38Y) for use in performing a remotely requested convenience function. Each of the plurality of transmitters (20A–20C) include capability of being configurable to be compatible with any of the plurality of receivers (30X–30Y) for outputting a remote convenience function request signal to cause remote control performance of a function at the respective device (35X or 35Y).

11 Claims, 6 Drawing Sheets

200

Fob ID 210

220

| 222 | 224 | 226 | 228 |
|---|---|---|---|
| DeviceID=0 | EncrpKey[0] | SeqCnt[0] | Channel[0] |
| DeviceID=1 | EncrpKey[1] | SeqCnt[1] | Channel[1] |
| DeviceID=2 | EncrpKey[2] | SeqCnt[2] | Channel[2] |
| DeviceID=3 | EncrpKey[3] | SeqCnt[3] | Channel[3] |
| DeviceID=4 | EncrpKey[4] | SeqCnt[4] | Channel[4] |
| DeviceID=5 | EncrpKey[5] | SeqCnt[5] | Channel[5] |
| DeviceID=6 | EncrpKey[6] | SeqCnt[6] | Channel[6] |
| DeviceID=7 | EncrpKey[7] | SeqCnt[7] | Channel[7] |

Fig.4

300

DeviceID 310

330

320 Channel

| 332 | 334 | 336 |
|---|---|---|
| FobID [0] | EncrpKey[0] | SeqCnt[0] |
| FobID [1] | EncrpKey[1] | SeqCnt[1] |
| FobID [2] | EncrpKey[2] | SeqCnt[2] |
| FobID [3] | EncrpKey[3] | SeqCnt[3] |
| FobID [4] | EncrpKey[4] | SeqCnt[4] |
| FobID [5] | EncrpKey[5] | SeqCnt[5] |
| FobID [6] | EncrpKey[6] | SeqCnt[6] |
| FobID [7] | EncrpKey[7] | SeqCnt[7] |

Fig.5

CONFIGURABLE ARRANGEMENT OF MULTIPLE TRANSMITTERS AND MULTIPLE RECEIVERS FOR THE PERFORMANCE OF REMOTE CONVENIENCE FUNCTIONS

TECHNICAL FIELD

The present invention relates to remote convenience systems, and is particularly directed to arrangements configured to support communications between a plurality of portable transceivers and a plurality of device-based transceivers.

BACKGROUND OF THE INVENTION

Remote convenience systems are known in the art. Such remote convenience systems permit remote control of certain functions. One type of remote convenience system is for remotely controlling vehicle functions. Other example types of remote convenience systems include garage door opener systems and entry light activation systems.

Focusing now on the remote convenience vehicle systems, examples of remotely controlled functions include locking and unlocking of one or more vehicle doors. A remote convenience vehicle system that permits remote locking and unlocking functions is commonly referred to as a remote keyless entry system.

Such remote convenience vehicle systems may provide for control of other vehicle functions. For example, a remote vehicle locator function may be provided. The vehicle locator function causes the vehicle horn to emit a horn chirp and/or the headlights of the vehicle to flash "ON". This allows a person to quickly locate their vehicle within a crowded parking lot.

Known remote convenience vehicle systems include a receiver unit mounted in an associated vehicle and at least one portable, hand-held transmitter unit located remote from the receiver unit. Each transmitter unit is provided with one or more manually actuatable pushbutton switches. Each pushbutton switch is associated with a remote control vehicle function to be performed. The transmitter unit includes circuitry that responds to the actuation of each pushbutton switch to transmit a message in the form of a digital signal.

As the sophistication of vehicles has increased, the number and complexity of vehicle systems has increased. Following this increase in number and complexity of vehicle systems, there has been a movement toward an increase in the number of systems and the number of tasks that are to be remotely controlled.

Focusing now on remote convenience functions that are part of non-vehicle systems (e.g., garage door opener systems and entry light activation systems), there has also been an increase in the number of devices and tasks that are to be remotely controlled. Thus, it is common for a person to have a portable transmitter unit associated with a remote convenience vehicle system, a portable transmitter unit associated with a garage door opener system, and a portable transmitter unit associated with an entry light activation system.

It is common for a person to have authorized access to a plurality of vehicles. Accordingly, the person may have a plurality of portable transmitter units, each unit being associated with a different vehicle.

SUMMARY OF THE INVENTION

In accordance with one aspect, the present invention provides an arrangement for remotely controlling convenience functions at a plurality of devices. Each device-based receiver means in a plurality of device-based receiver means, receives a remote convenience function request signal and conveys a remote convenience function request message to a device operations system for use in performing a remotely requested convenience function. Each portable transmitter means in a plurality of portable transmitter means, is configurable to be compatible with any of the plurality of receiver means for outputting a remote convenience function request signal to cause remote control performance of a function at the respective device.

In accordance with another aspect, the present invention provides a convenience function request message for transmission by one of a plurality of portable transmitters to perform a remote convenience function on a device in an arrangement having a plurality of devices. The request message includes portable transmitter configuration information and device configuration information.

In accordance with another aspect, the present invention provides configuration information stored in the memory of a portable transmitter. The configuration information includes a portable transmitter serial number and a transmitter entity table.

In accordance with another aspect, the present invention provides configuration information stored in the memory of a device-based receiver. The configuration information includes a device identification number, a communication channel number, and a receiver entity table.

In accordance with another aspect, the present invention provides a method for remotely controlling convenience functions on one of a plurality of devices using one of a plurality of portable transmitters in a configured arrangement. Input is received at a transmitter from an operator designating a device-based receiver from a plurality of device-based receivers for which the transmitter is to be compatible in the configured arrangement. A subset of transmitter configuration information is retrieved from transmitter memory according to the input received from the operator. The transmitter configuration information allows the transmitter to have compatibility with a plurality of receivers.

Input is received at the transmitter from the operator. The input received is indicative of a remote convenience function request. A remote convenience function request message is generated at the transmitter. The portion of the subset of the transmitter configuration information that corresponds to the receiver selected by the operator is used in the convenience function request message. The remote convenience function request message is encrypted at the transmitter. The encrypted remote convenience function request message is transmitted from the transmitter.

The remote convenience function request message is received at the receiver. The validity of the remote convenience function request message is determined according to the receiver configuration information stored in receiver memory. The receiver configuration information allows the receiver to have compatibility with the plurality of transmitters.

The valid remote convenience function request message is decrypted at the receiver that determined that it received a valid remote convenience function request message. The remote convenience function request contained within the received convenience function request message is conveyed to the device operations system of the device whose receiver determined that it received a valid remote convenience function request message.

BRIEF DESCRIPTION OF THE DRAWINGS

The foregoing and other features and advantages of the present invention will become apparent to those skilled in the art to which the present invention relates upon reading the following description with reference to the accompanying drawings, wherein:

FIG. 4 is an illustration of the configuration information stored in the memory of a portable transceiver;

FIG. 5 is an illustration of the configuration information stored in the memory of a device-based transceiver;

DESCRIPTION OF EXAMPLE EMBODIMENT

Figure 1:
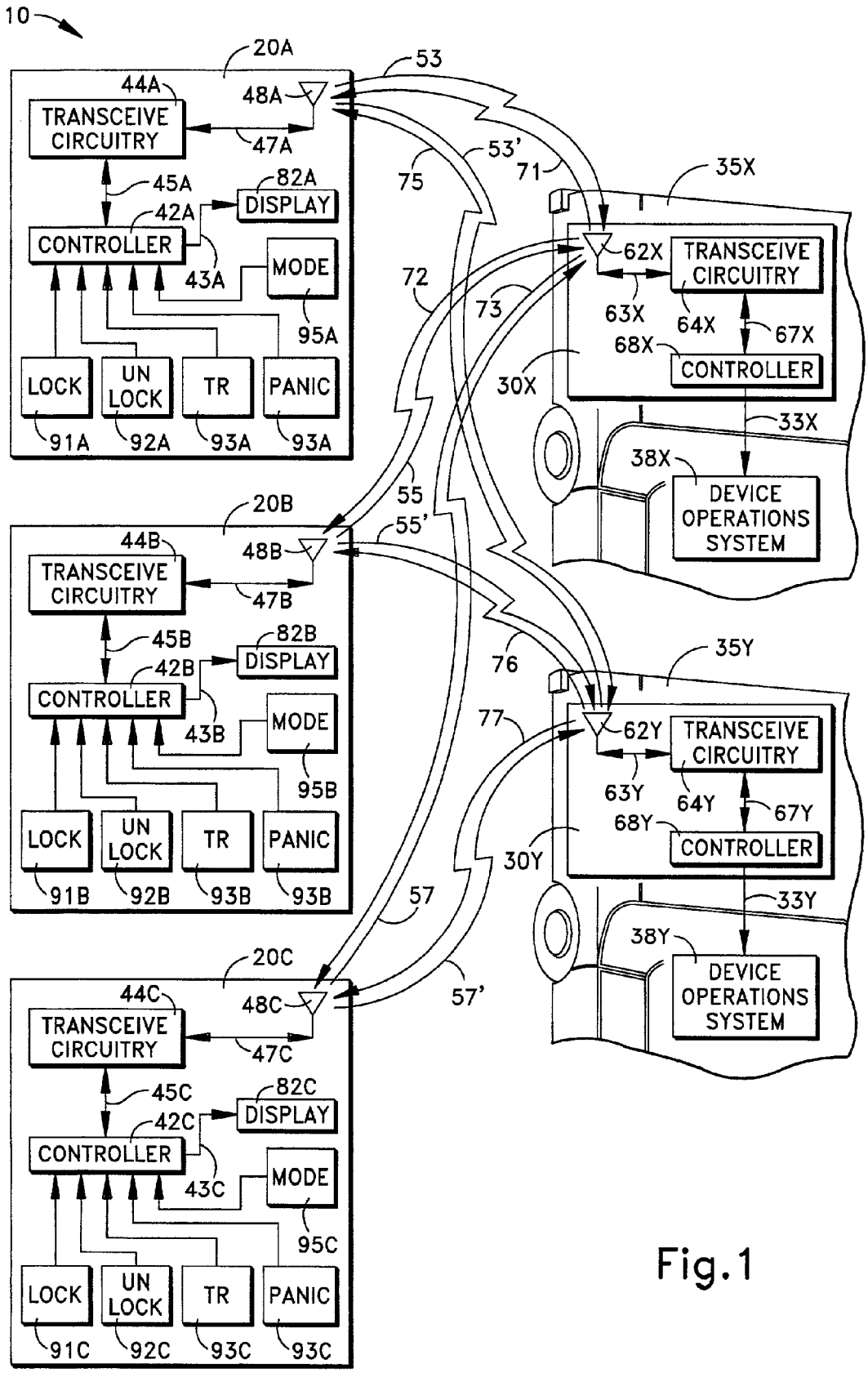
FIG. 1 is a function block diagram of an arrangement for remote control of convenience functions featuring a plurality of portable transceivers and a plurality of devices.

An arrangement 10 for remote control of convenience functions, in accordance with the present invention, is schematically shown in FIG. 1. For ease of illustration and discussion, similar components of the arrangement 10 are identified by identical reference numerals, but with different letter suffixes. It is to be appreciated that the similar components may or may not have identical structures or configurations.

The embodiment of the arrangement 10 depicted in FIG. 1 includes portable hand-held transceiver units 20A, 20B, and 20C (hereinafter referred to as "the portable transceivers") and device-based transceiver units 30X and 30Y (hereinafter referred to as "the device-based transceivers"). The device-based transceivers 30X and 30Y are located at devices 35X and 35Y, respectively. In the presented embodiment, the devices 35X and 35Y are vehicles, and authorized users (e.g., vehicle owners) of the vehicles hold the portable transceivers 20A–20C.

It is to be appreciated that the presented embodiment is an example and that modifications are possible. Possible modifications include a different number of portable and/or device-based transceivers. As another possibility, the device-based transceivers may be associated with non-vehicles devices. Such devices may be buildings (e.g., houses) or other products that would be associated with the use of remote convenience functions. Also, the arrangement 10 may be configured so that a combination of device types (e.g., vehicles and buildings) coexists in the same arrangement.

At each device (e.g., 35X) is a device operations system (e.g., 38X) that is remotely controlled via at least one of the portable transceivers 20A–20C. Depending on the type of device, the remotely-controlled function may be associated with door locks, trunk lids, engine ignitions, windows, headlights, horn, seat controls, building lights, and garage doors. Specifically, examples of remotely-controlled convenience functions include, for example, locking and unlocking doors, opening and closing windows, and turning lights ON and OFF.

Each portable transceiver (e.g., 20A), is capable of communicating (transmitting and receiving) with any device-based transceiver (e.g., 30X) from a remote location. Each device-based transceiver (e.g., 30X) is capable of communicating (transmitting and receiving) with any portable transceiver, (e.g., 20A). Specifically, each portable transceiver (e.g., 20A) is operable by a user to communicate a convenience function request to an operator-selected device (e.g., 35X) so that remote control performance of at least one convenience function (e.g., unlock doors) is achieved at the operator-selected device. In the arrangement 10 shown in FIG. 1, the user of one of the portable transceivers (e.g., 20A) selects either device 35X or device 35Y for performance of a convenience function thereat. The device-based transceiver (e.g., 30X), whose associated device was selected by the user to perform a convenience function, can transmit information feedback, and the like, to the portable transceiver that requested the convenience function. Thus, two-way communications exists.

Also, the arrangement 10 allows a plurality of users to control a plurality of devices. The arrangement 10 illustrated in FIG. 1 is configured so that each portable transceiver (e.g., 20A) can remotely control the respective device operations systems 38X and 38Y of devices 35X and 35Y through communications with each device's respective device-based transceiver, 30X, 30Y. Thus, any portable transceiver 20A–20C can control any device 35X, 35Y in the arrangement 10 of FIG. 1.

Further, the arrangement 10 may be configured so that a particular portable transceiver (e.g., 20A) can remotely control only some (e.g., 35X) of the devices. For example, the arrangement 10 illustrated in FIG. 1 may be configured to allow portable transceiver 20A to control device 35X, portable transceiver 20B to control device 35Y, and portable transceiver 20C to control devices 35X and 35Y. Such configuration is termed "mixing-and-matching". Thus, depending on the configuration of the arrangement 10, a given portable transceiver may control the functions on some or all of the devices in an arrangement.

Consider, for the moment, portable transceiver 20A of the arrangement 10 shown in FIG. 1. The portable transceiver 20A includes a controller 42A that generates/assembles a "packet" of information to be transmitted to the device-based transceivers 30X, 30Y. The packet of information includes a convenience function request. Radio frequency (RF) transceive circuitry 44A is operatively connected 45A to controller 42A to receive the message packet that is to be transmitted. The RF transceive circuitry 44A is operatively connected 47A to an antenna 48A. In response to an electrical stimulus that conveys the message packet, the antenna 48A broadcasts an electromagnetic signal (e.g., 53 or 53') that conveys the message packet. For ease of illustration and discussion, electromagnetic signals bearing the same message packet from a portable transceiver are referred to by a like number with the absence or presence of a prime (') suffix. Similarly, electromagnetic signals 55, 55' originate from the portable transceiver 20B, and electromagnetic signals 57, 57' originate from the portable transceiver 20C.

In one example, transmitted signals 53, 53', 55, 55', 57, 57' are pulse-width-modulated (PWM) signals that have a radio frequency (RF) carrier frequency. It is to be appreciated that other signal types (e.g., frequency modulation, frequency shift key, or the like) may be used without deviating from the present invention.

Turning now to the device-based transceiver (e.g., 30X), an antenna 62X receives the transmitted signal (e.g., 53) broadcast from a portable transceiver (e.g., 20A). For this discussion, the device-based transceiver 30X could have received a different signal (e.g., 55) from another portable transceiver (e.g., 20B). Antenna 62X, which is operatively connected 63X to RF transceive circuitry 64X, outputs an electrical signal that conveys the message packet to the RF transceive circuitry 64X. In turn, the RF transceive circuitry 64X communicates the message packet, via a connection 67X, to a controller 68X. As part of the functions performed by the controller 68X, the controller determines if the broadcast signal 53 is intended for the associated device 35X and outputs appropriate control commands to the device operations system 38X.

As noted above, each broadcast signal, 53, 53', 55, 55', 57, 57', illustrated in FIG. 1, bears a convenience function message intended to cause performance by a device operations system selected by an operator. When a portable transceiver transmits a broadcast signal, all of the device-based transceivers in the arrangement may receive the transmitted broadcast signal. Each device-based transceiver, 30X, 30Y, decodes the broadcast signal and determines if the convenience function message is intended for its own respective device operations system 38X, 38Y.

If the convenience function message is determined to not be intended for a device's operations system, then the device-based transceiver goes into sleep mode to await another broadcast signal from a portable transceiver. If the convenience function message is determined to be intended for a device's operations system, then the requested convenience function is performed. In one example, a status response message is transmitted by the device-based transceiver to the portable transceiver that requested the convenience function. Depicted in FIG. 1 are signals 71, 72, 73, 75, 76, 77 which bear the status response messages transmitted from devices 35X, 35Y.

Preferably, the transmitted signals 71, 72, 73, 75, 76, 77 are pulse-width-modulated (PWM) signals that have a radio frequency (RF) carrier frequency. It is to be appreciated that other signal types (e.g., frequency modulation, frequency shift key or the like) may be used without deviating from the present invention.

It is to be appreciated that each portable transceiver can control a plurality of types of remotely controlled devices (e.g., vehicles, buildings, etc.) as well as a plurality of functions at each device. Each portable transceiver is configured to provide a great amount of control via its single unit without the unit having undue bulk or size.

Figure 2:
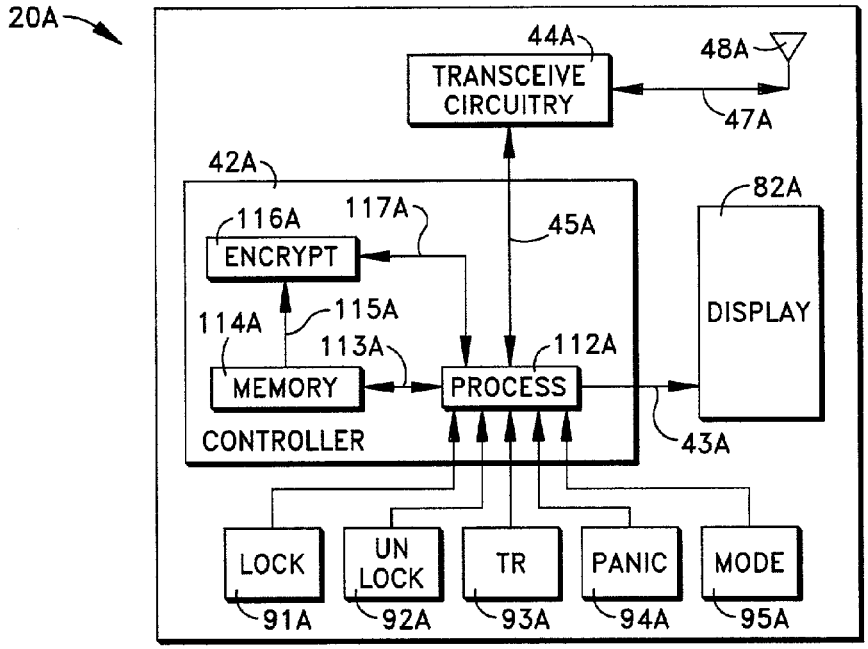
FIG. 2 is a detailed function block diagram of one of the plurality of portable transceivers illustrated in FIG. 1.

The portable transceiver 20A illustrated in FIG. 2 in greater detail is an example of the configuration of the portable transceivers 20A, 20B, and 20C (FIG. 1). It is to be appreciated that the portable transceivers 20B and 20C may have similar structure.

The portable transceiver 20A (FIG. 2) includes a plurality of manually actuatable pushbutton selector switches. In the example there are five pushbutton switches 91A–95A. The pushbutton switches 91A–95A are identified by indicia labels "lock", "unlock", "TRUNK" or "TR", "panic", and "mode". It is to be appreciated that the indicia used within the example are chosen merely to aid the operator in identifying and remembering various pushbutton switches. It is to be appreciated that different indicia may be utilized.

The first-fourth pushbutton switches 91A–94A (i.e., identified by lock, unlock, TR, and panic) are associated with requests for remote convenience function performance. Actuation of the fifth (mode) pushbutton switch 95A on portable transceiver 20A signals the controller 42A to change between the modes in which convenience functions at different devices are to be controlled. Selecting a mode on a portable transceiver is, in effect, selecting a device to control. Each actuation of the fifth (mode) pushbutton switch 95A toggles through the devices configured on a particular portable transceiver. The number of devices an operator is able to toggle through is dependent on the configuration of the arrangement in general and the number of devices configured on his or her portable transceiver in particular.

For example, the arrangement 10 illustrated in FIG. 1 may be configured to allow portable transceiver 20A to control devices 35X and 35Y. Thus, portable transceiver 20A would be able to toggle between devices 35X and 35Y. It is to be appreciated that the first-fourth pushbutton switches 91A–94A may have their associated functions changed depending on the type of device that is selected with the fifth (mode) pushbutton switch 95A.

In order for the operator of the portable transceiver 20A (FIG. 2) to know the convenience functions currently assigned to the pushbutton switches 91A–94A, a display 82A is provided on the portable transceiver 20A. The display 82A can also provide an operator information about the current mode of the portable transceiver 20A and certain response or acknowledgement information provided from a device-based transceiver (e.g., 30X, FIG. 1). In one example, the display 82A (FIG. 2) is a liquid crystal display capable of displaying alphanumeric characters and/or other symbology. Designated alphanumeric character phrases and symbols can be used to denote certain types of information. For example, icons can be used to denote the device mode of the portable transceiver 20A while alphanumeric character phrases can be used to indicate the current first and second pushbutton switch assignments as well as any response/acknowledgements received from device-based transceivers. Other character/symbol arrangements may be used to denote the different types of information. Structurally, as shown in FIG. 2, the display 82A is operatively connected 43A to the controller 42A.

Each device (e.g., 35X, FIG. 1) can provide response or feedback to the portable transceiver 20A. The response or feedback can be associated with the performance of a remote convenience function. For example, if the remotely requested function is to lock a vehicle's doors, the device-based transceiver located at the vehicle may respond with an acknowledgement that the vehicle doors have been locked as requested. Similarly, if the requested function is to turn OFF the light at a building, the response signal from the device-based transceiver located at the building may be an acknowledgement that the light has indeed been turned OFF.

Turning attention to the controller 42A of the portable transceiver 20A illustrated in FIG. 2, the controller has at least three portions. A process portion 112A controls the controller 42A and processes information. A memory portion 114A stores information The memory portion 114A is preferably an electrically erasable programmable read-only memory (EEPROM), but can be any non-volatile memory that can be programmed by the circuitry within the portable transceiver. An encrypt portion 116A encrypts messages for secure communications to devices (e.g., 35X, FIG. 1). It is to be appreciated that the functions performed within the blocks of the controller part of the diagram shown in FIG. 2 may be accomplished by discrete hard-wired elements, a processor performing a program, or a combination thereof.

Internal to the controller 42A (FIG. 2), the process portion 112A (FIG. 2) is operatively connected 113A to the memory portion 114A. The process portion 112A is operatively connected 117A to the encrypt portion 116A. The memory portion 114A is operatively connected 115A to the encrypt portion 116A.

In response to pushbutton actuation, the process portion 112A of the controller 42A generates/assembles a message package containing information that is to be transmitted. Preferably, data strings that represent the information are retrieved from the memory portion 114A of the controller 42A. The message package information that is generated/assembled within the controller 42A includes a start/wakeup instruction, a security code, and at least one command that represents the remote function request. The encrypt portion 116A (FIG. 2) encrypts at least some of the information that is to be transmitted to the device-based transceiver (e.g., 30X, FIG. 1) in order to prevent unauthorized interception and use. The portions of the message information that are encrypted preferably include the security code and the commands. To further increase security, a sequence counter is also part of the message information. The sequence counter is changed (e.g., advanced) for each transmission a portable transceiver makes to a device-based transceiver. Encryption is also used to secure the sequence counter during transmission.

The process portion 112A of the portable transceiver controller 42A is operatively connected to at least the following-mentioned elements, which are external to the controller. The process portion 112A of the controller 42A is operatively connected to the pushbutton switches 91A–95A. The process portion 112A is operatively connected 43A to the display 82A. The process portion 112A also is operatively connected 45A to the RF transceive circuitry 44A. The process portion 112A receives operator input from the pushbutton switches 91A–95A, outputs messages to the display 82A, and receives device-based transceiver messages from the RF transceive circuitry 44A. The process portion 112A also sends secure convenience function request messages to the RF transceive circuitry 44A for transmission to devices 35X and 35Y.

Figure 3:
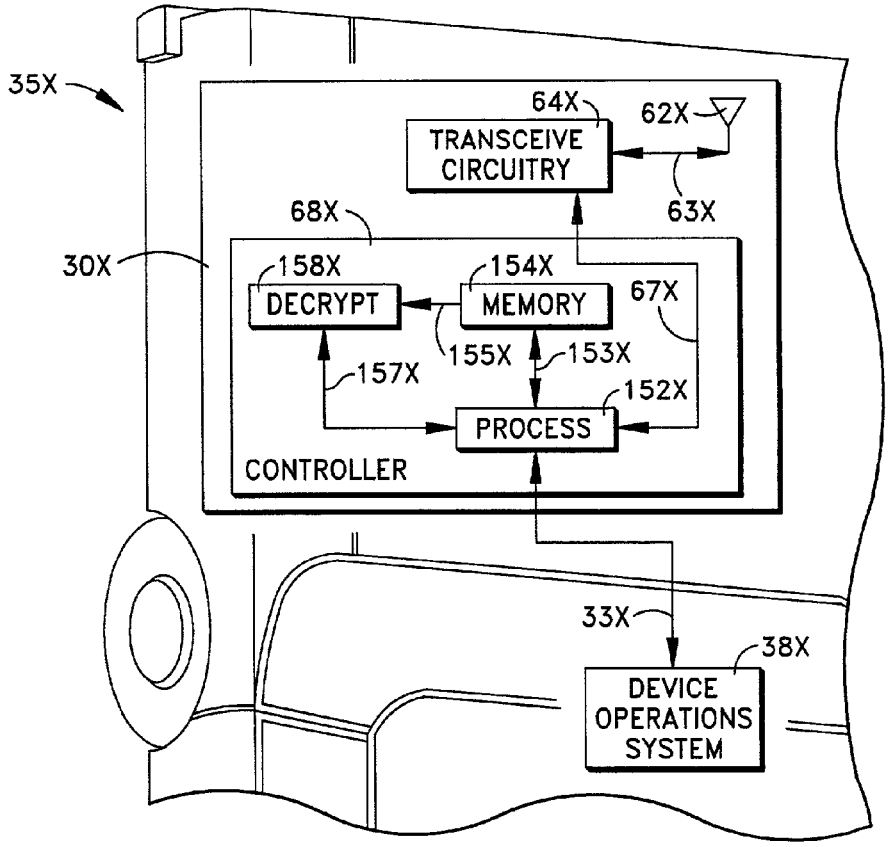
FIG. 3 is a function block diagram of one of the plurality of devices illustrated in FIG. 1 with detailed view of the device-based transceiver.

The device-based transceiver 30X illustrated in FIG. 3 in greater detail is an example of the configuration of the device-based transceivers 30X and 30Y (FIG. 1). It is to be appreciated that the device-based transceiver 30Y may have similar structure.

Turning to the controller 68X of device-based transceiver 30X illustrated in FIG. 3, the controller has at least three portions. A process portion 152X controls the controller 68X and processes information. A memory portion 154X stores information. The memory portion 154X is preferably an EEPROM, but can be any non-volatile memory that can be programmed by the circuitry within the device-based transceiver. A decrypt portion 158X decrypts messages determined valid by the process portion 152X. It is to be appreciated that the functions performed within the blocks of the controller part of the diagram shown in FIG. 3 may be accomplished by discrete hard-wired elements, a processor performing a program, or a combination thereof.

Internal to the controller 68X, the process portion 152X is operatively connected 153X to the memory portion 154X. The process portion 152X is operatively connected 157X to the decrypt portion 158X. The memory portion 154X is operatively connected 155X to the decrypt portion 158X.

The process portion 152X of the controller 68X is operatively connected 33X to the device operations system 38X of the device 35X. The process portion 152X conveys a valid convenience request to the device operations system 38X. The process portion 152X is operatively connected to the RF transceive circuitry 64X. The process portion 152X receives convenience function request messages from the RF transceive circuitry 64X. The process portion 152X sends convenience function status messages to the RF transceive circuitry 64X for transmission to the portable transceiver that transmitted a function request.

When a convenience function request signal is received by the RF transceive circuitry 64X, the RF transceive circuitry 64X communicates the message packet contained in the signal to the process portion 152X of the controller 68X. The process portion 152X determines if the convenience function request message is intended for its associated device operations system 38X. If the process portion 152X determines that the convenience function request message is not intended for its associated device operations system 38X, then the process portion goes into sleep mode and the device-based transceiver awaits another remote convenience function signal.

If the process portion 152X of the controller 68X determines that the convenience function request message is intended for its associated device operations system 38X, then the decrypt portion 158X of the controller 68X decrypts the encrypted portion of the convenience function request message. The process portion 152X then conveys the convenience function request to its device operations system 38X.

Upon completion of the remotely requested function, the device operations system 38X provides status information to the process portion 152X. The process portion 152X accesses the memory portion 154X to retrieve appropriate information for the response or acknowledgement. The stored information includes stored messages used to respond/acknowledge, the security code, etc. A status response message packet is assembled within the process portion 152X and output to the RF transceive circuitry 64X for transmission to the portable transceiver that transmitted the enacted convenience function request.

Turning now to the configuration of the portable transceiver (e.g., 20A), configuration information 200 (FIG. 4) is stored in the memory (e.g., 114A) of each portable transceiver in the arrangement 10. The example of FIG. 4 illustrates the type of information stored in memory, where the memory is preferably EEPROM. The arrangement that uses the information shown in FIG. 4 can support up to eight devices. As noted earlier, any number of devices can be configured into an arrangement up to the limit of what is configurable. In one example, the limit is based on the amount of memory available to store all of the required information for each device and the maximum number of communication channels in the arrangement. The memory in each portable transceiver stores, as a minimum, a portable transceiver serial number 210 and an entity table 220.

Each portable transceiver has a distinctive serial number 210 that is referred to by the variable name FobID. (Portable transceivers are otherwise known as fobs.) The FobID is programmed into the memory of a portable transceiver at the time of manufacture.

The entity table stores access information for all of the device-based transceivers the portable transceiver is configured to access. The entity table 220 illustrated in FIG. 4 has a maximum of eight entities, or possible devices, it can configure. Each entity in the entity table 220 has at least four types of information associated with it: a device number 222, referred to by the variable name DeviceID; an encryption key 224, referred to by EncrptKey; a sequence counter 226, referred to by SeqCnt; and a communications channel 228, referred to by the variable name Channel.

The device number 222 (DeviceID) is an index number that represents a device's identification number within the arrangement which is set during configuration of the arrangement. The encryption key 224 (EncrptKey) is an encryption code for transmitting secure remote convenience messages to configured device-based transceivers. The encryption key for each entity in the entity table 220 of a portable transceiver is set at the time of manufacture. The sequence counter 226 (SeqCnt) is changed (e.g., advanced) for each transmission a portable transceiver makes to a device-based transceiver. The sequence counter 226 is set during configuration of the arrangement. The communications channel 228 (Channel) identifies the RF channel that communications will take place between the portable transceiver and each particular device in the entity table. The communications channel 228 (Channel) is set during configuration of the arrangement.

When the device mode pushbutton switch (e.g., 95A) is actuated on a portable transceiver (e.g., 20A) to select a particular device-based transceiver, the device number 222 (DeviceID) of the device to be controlled is retrieved from the memory portion of the controller. The corresponding encryption key 224 (EncrptKey), sequence counter 226 (SeqCnt), and communications channel 228 (Channel) are also retrieved from memory. The retrieved information is used to establish communications with the selected device-based transceiver. Thus, each portable transceiver has information stored in its entity table for each device-based transceiver it is configured to communicate with.

Turning now to the configuration of the device-based transceiver (e.g., 30X, FIG. 1), configuration information 300 (FIG. 5) is stored in the memory (e.g., 154X) of each device-based transceiver in the arrangement 10. The example of FIG. 5 illustrates the type of information stored in memory, where the memory is preferably EEPROM. The arrangement that uses the information shown in FIG. 5 can support up to eight portable transceivers. As noted earlier, any number of portable transceivers can be configured into an arrangement up to the limit of what is configurable. That limit is based on the amount of memory available to store all of the required information for each portable transceiver and the maximum number of communication channels capable of being used in the arrangement. The memory in each device-based transceiver stores, as a minimum, a device identification number 310 (DeviceID), a communications channel number 320 (Channel), and an entity table 330.

Each device-based transceiver is identified in an arrangement by its DeviceID, which is programmed during the configuration process. Each device-based transceiver also has a fixed communications channel number 320, designated by the variable Channel, stored in its memory. The fixed communications channel number 320 (Channel) matches the channel number stored in the memory of the portable transceiver configured to communicate with that device. The channel number 320 (Channel) is set during the configuration process. Each device-based transceiver has information stored in its entity table for each portable transceiver it is configured to communicate with.

Each entity in the device-based transceiver entity table corresponds to a single portable transceiver in the arrangement the device-based transceiver is configured to communicate with. Each entity in the entity table 330 has at least three types of information associated with it: a portable transceiver serial number 332, referred to by the variable name FobID; an encryption key 334, referred to by EncrptKey; and a sequence counter 336, referred to by the variable name SeqCnt.

Figure 6:
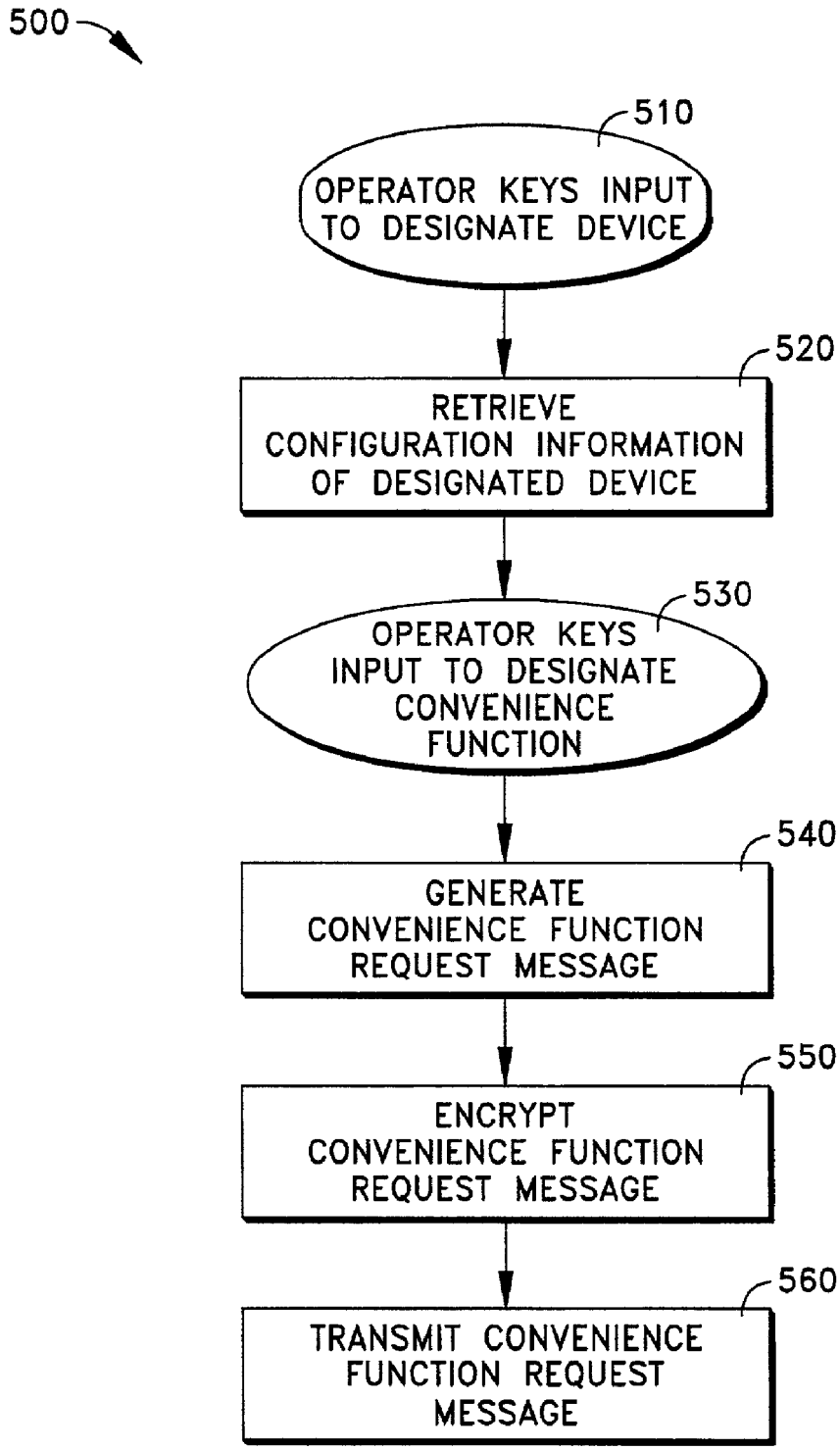
FIG. 6 is a flow chart for a process performed by a portable transceiver.

Turning attention to FIG. 6, a portable transceiver uses the method 500, as a minimum, to transmit a convenience function to a device. In step 510, an operator actuates the device mode pushbutton switch to designate a device to control and, consequently, a device-based transceiver to communicate with. In step 520, the process portion of the portable transceiver controller retrieves configuration information for a device-based transceiver from the entity table in the memory portion of the portable transceiver controller. The configuration information retrieved is based on the device-based transceiver the operator selected by actuating the device mode pushbutton switch.

In step 530, the operator actuates the appropriate pushbutton to initiate convenience function activation. In step 540, the process portion of the controller generates a convenience function request message packet based on the pushbutton switch actuation and the information loaded from the memory. In step 550, the encrypt portion of the controller encrypts at least some of the convenience function request message. In step 560, the RF circuitry in conjunction with the antenna transmits the convenience function request message on the communication channel specified by the information retrieved from the entity table. Part of the convenience function request message contains the DeviceID and the FobID. The DeviceID is not encrypted and a portion of the FobID is encrypted. All of the devices in the communication range receive this message.

Figure 7:
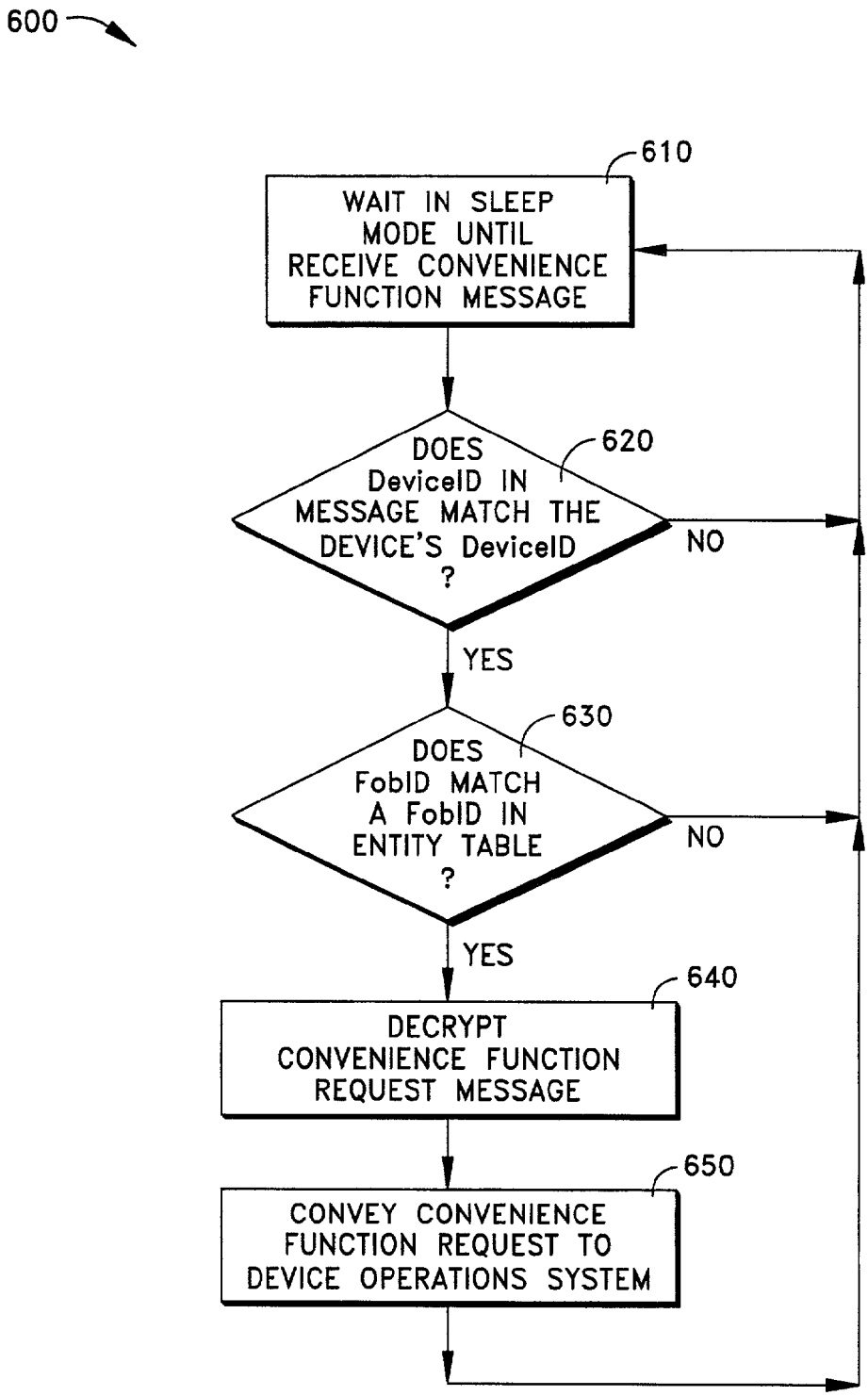
FIG. 7 is a flow chart for a process performed by a device-based transceiver.

Turning to FIG. 7, the device-based transceivers use the method 600, as a minimum, to handle a transmitted convenience function message. In step 610, each device-based transceiver in the arrangement waits in sleep mode until it receives a transmitted convenience function message. In step 620, the device-based transceiver determines if the unencrypted DeviceID portion of the transmitted remote convenience function request message matches the DeviceID stored in its memory. If a device-based transceiver determines that the DeviceID does not match (i.e., the determination at step 620 is negative), then that device-based transceiver waits in sleep mode (e.g., return to step 610) until it receives another remote convenience function request message.

If a device-based transceiver determines that the DeviceID does indeed match (i.e., the determination at step 620 is affirmative), then the process proceeds to step 630. At step 630, the device-based transceiver determines if the unencrypted part of the FobID in the transmitted remote convenience function request message matches the FobID stored in its entity table in memory. If the FobID does not match (i.e., the determination at step 630 is negative), then that device-based transceiver waits in sleep mode (e.g., return to step 610) until it receives another remote convenience function request message.

If the FobID does match (i.e., the determination at step 630 is affirmative), then the process proceeds to step 640. At step 640, the device-based transceiver decrypts the remote convenience function request message. At step 650, the device-based transceiver conveys the convenience function request to the device operations system of the associated device.

The process of configuring the arrangement sets the memory portion of the controllers in both the portable transceivers and the device-based transceivers. The variables mentioned above are set in the corresponding transceivers during the configuration process.

Figure 8:
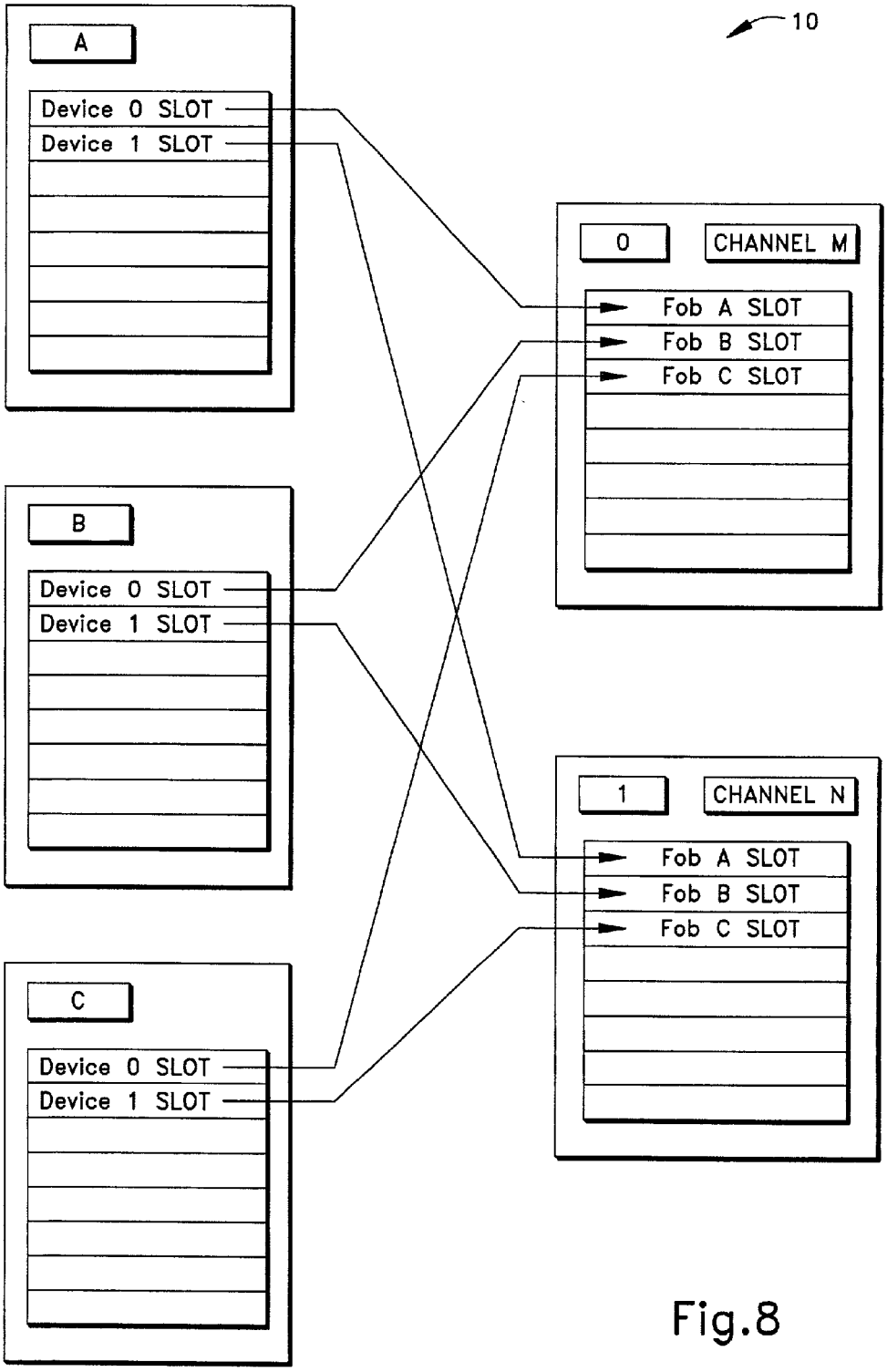
FIG. 8 is an illustration of the configuration information stored in the memory of the portable and device-based transceivers depicted in FIG. 1.

Illustrated in FIG. 8 is the same arrangement 10 shown in FIG. 1 but viewed with only the configuration information stored in the memory of each transceiver. FIG. 8 shows the configuration information for the arrangement 10 of three portable transceivers and two device-based transceivers. The arrangement 10 can support up to 8 portable transceivers and 8 devices-based transceivers. An eight-element entity table in the memory of each portable transceiver represents eight possible devices the portable transceiver can access. Each portable transceiver in FIG. 8 is configured to communicate with two different device-based transceivers. If a pushbutton switch is pressed on portable transceiver 20A (FobID A) to communicate with device-based transceiver 30Y (DeviceID=1), then EncrptKey[1], SeqCnt[1], and Channel[1] will be loaded from portable transceiver memory to establish communications.

A DeviceID is a unique number from 0 to 7 assigned to each device during the configuration process. Each device-based transceiver stores information about each portable transceiver it is configured to communicate with. Likewise, an eight-element entity table in the memory of each device-based transceiver represents eight possible portable transceivers the device-based transceiver can communicate with. Each device-based transceiver in FIG. 8 is configured to communicate with three different portable transceivers.

Thus, the configuration of arrangement 10 allows a plurality of operators to control a plurality of devices by using a plurality of portable transceivers to communicate with a plurality of device-based transceivers. The limit to the number of portable transceivers communicating with device-based transceivers in an arrangement is limited only by the maximum number of transceivers, portable and device-based, configurable by the arrangement. Each portable transceiver can also control a plurality of types of remotely controlled devices (e.g., vehicles, buildings, etc.) as well as a plurality of functions at each device. Although each portable transceiver must be capable of communicating with each device-based transceiver, the remote arrangement 10 can be configured so that a particular portable transceiver unit may remotely control the functions on some or all of the devices.

From the above description of the invention, those skilled in the art will perceive improvements, changes and modifications. For example, the arrangement could be configured to operate without two-way communication between the portable transceiver and the device-based transceiver. Thus, the portable unit would be a transmitter unit, and the device-based unit would be receiver units. Such improvements, changes and modifications within the skill of the art are intended to be covered by the appended claims.

Having described the invention, the following is claimed:

1. An arrangement for remotely controlling convenience functions of a plurality of vehicles, the arrangement comprising:

a plurality of vehicle-based receivers, each one of the plurality of vehicles including an associated one of the plurality of vehicle-based receivers, each vehicle-based receiver having an associated identification and being configured to receive remote convenience function request signals, each vehicle-based receiver being responsive to receipt of a remote convenience function request signal including its associated identification for controlling performance of a requested convenience function; and a portable transmitter for transmitting remote convenience function request signals, the portable transmitter capable of communicating with the plurality of vehicle-based receivers, the portable transmitter including a memory in which is stored the associated identification of each of the plurality of vehicle-based receivers, the portable transmitter including means for selecting an associated identification of one of the plurality of vehicle-based receivers for which to include in remote convenience function signals to be transmitted, wherein each vehicle-based receiver is part of a vehicle-based transceiver that further includes a vehicle-based transmitter for transmitting a feedback signal, the portable transmitter being part of a portable transceiver that includes a receiver portion for receiving the feedback signal, the portable transceiver further including a display for indicating receipt of the feedback signal.

2. The arrangement of claim 1 wherein the means for selecting an associated identification includes a pushbutton switch, actuation of the pushbutton switch selecting the associated identification to be included in the remote convenience function signals.

3. The arrangement of claim 1 further including a plurality of operations systems, each one of the plurality of vehicle-based receivers having an associated one of the plurality of operations systems, each of the plurality of operations systems being configured to perform a convenience function, each vehicle-based receiver, in response to receiving a remote convenience function request signal including its associated identification, controlling its associated operations system to perform the convenience function.

4. The arrangement of claim 3 wherein the convenience function includes changing a locked condition of a vehicle door.

5. The arrangement of claim 1 wherein each of the vehicle-based receivers includes an associated decryption key for decrypting portions of received remote convenience function request signals, the means for selecting an associated identification also selecting an encryption key for encrypting remote convenience function request signals, the selected encryption key corresponding to the decryption key for the vehicle-based receiver having the associated identification.

6. The arrangement of claim 1 wherein the portable transmitter further includes means for receiving input from a user indicative of the convenience function to be performed.

7. The arrangement of claim 6 wherein the means for receiving input from the user includes a plurality of pushbutton switches, each of the pushbutton switches having an associated convenience function.

8. The arrangement of claim 1 wherein the memory of the portable transmitter includes configuration information, the configuration information including a serial number associated with the portable transmitter and an entity table that includes the identification associated with each of the vehicle-based receivers.

9. The arrangement of claim 8 wherein the entity table of the portable transmitter further includes an encryption key, a sequence counter, and a communication channel number for each of the vehicle-based receivers.

10. The arrangement of claim 9 wherein each of the vehicle-based receivers includes a memory in which its associated identification is stored, the memory of each vehicle-based receiver also including an associated communication channel number and a receiver entity table.

11. The arrangement of claim 10 wherein the receiver entity table of each of the vehicle-based receivers further includes the serial number associated with the portable transmitter, a decryption key, and a sequence counter.

* * * * *